US006732670B2

(12) United States Patent
Rayner

(10) Patent No.: US 6,732,670 B2
(45) Date of Patent: May 11, 2004

(54) SAILING CRAFT

(76) Inventor: William Richards Rayner, 20 Darley Street, Neutral Bay, NSW 2089 (AU)

( * ) Notice: Subject to any disclaimer, the term of this patent is extended or adjusted under 35 U.S.C. 154(b) by 0 days.

(21) Appl. No.: 10/297,817

(22) PCT Filed: May 29, 2001

(86) PCT No.: PCT/AU01/00638

§ 371 (c)(1),
(2), (4) Date: Dec. 10, 2002

(87) PCT Pub. No.: WO01/96176

PCT Pub. Date: Dec. 20, 2001

(65) Prior Publication Data

US 2003/0121462 A1 Jul. 3, 2003

(30) Foreign Application Priority Data

Jun. 13, 2000 (AU) ..... PQ8099
Jun. 13, 2000 (AU) ..... PQ8100

(51) Int. Cl.[7] ..... B63B 35/00
(52) U.S. Cl. ..... 114/39.21
(58) Field of Search ..... 114/39.11, 39.12, 114/39.13, 39.15, 39.21, 39.25, 39.26, 39.27, 39.28, 39.29, 39.31, 39.32

(56) References Cited

U.S. PATENT DOCUMENTS

| | | | | |
|---|---|---|---|---|
| 1,885,247 | A | 11/1932 | Fox | |
| 3,985,090 | A | 10/1976 | Rineman | 114/39 |
| 4,064,821 | A | 12/1977 | Roberts, Jr. et al. | 114/103 |
| 4,068,607 | A | 1/1978 | Harmon | 114/102 |
| 4,116,406 | A | 9/1978 | Hamilton | 244/16 |
| 4,230,060 | A | 10/1980 | McCoy | 114/39 |
| 4,286,762 | A | 9/1981 | Prouty | 244/153 R |
| 4,341,176 | A | 7/1982 | Orrison | 114/102 |
| 4,367,688 | A | 1/1983 | Godfrey | 114/39 |
| 4,437,426 | A | 3/1984 | Latham | 114/103 |
| 4,469,040 | A | 9/1984 | Gougeon et al. | 114/104 |
| 4,473,023 | A | 9/1984 | Walker | 114/103 |

(List continued on next page.)

FOREIGN PATENT DOCUMENTS

| | | |
|---|---|---|
| AU | 80889/91 | 12/1991 |
| EP | 0 020 121 | 12/1980 |
| EP | 0 056 657 | 7/1982 |
| EP | 0 064 107 | 11/1982 |
| EP | 0 073 589 | 3/1983 |
| EP | 0 096 329 | 12/1983 |
| EP | 0 126 614 | 11/1984 |
| EP | 0 191 420 | 8/1986 |
| EP | 0 224 729 | 6/1987 |
| EP | 0 241 609 | 10/1987 |
| EP | 0 266 085 | 5/1988 |
| EP | 0 375 111 | 6/1990 |
| EP | 0 392 848 | 10/1990 |
| EP | 0 404 504 | 12/1990 |
| EP | 0 471 902 | 2/1992 |
| GB | 1184914 | 3/1970 |
| WO | WO00/26083 | 5/2000 |

*Primary Examiner*—Jesus D. Sotelo
(74) *Attorney, Agent, or Firm*—Steptoe & Johnson LLP; D. Douglas Price

(57) ABSTRACT

A sailing craft including a hull assembly (1,2), keel (3) and turret assembly (5) connected to the hull assembly (1, 2), for rotation about an axis. Turret assembly (5) is adapted to carry the craft's crew. The craft further includes mast (7) connected to and projecting from turret assembly (5) and sail assembly (8, 9, 10) connected to mast (7) in spaced relation to turret assembly (5). Sail assembly (8, 9, 10) includes sail member (8) which is movable relative to mast (7) for propelling the craft. Sail assembly (8, 9, 10) further includes wind vane (10) operable to position sail member (8) with respect to the wind direction. Sail member (8) may comprise an aerofoil shaped body. The combined center of mass of turret assembly (5), sail assembly (8, 9, 10) and the crew is designed to lie close to the rotational axis of turret bearing (6) while sailing.

16 Claims, 9 Drawing Sheets

U.S. PATENT DOCUMENTS 4,487,148 A 12/1984 Umeda ..... 114/106
4,501,216 A 2/1985 Voslamber ..... 114/102
4,506,619 A 3/1985 Bates et al. ..... 114/91
4,539,926 A 9/1985 Boffer ..... 114/39
4,541,355 A 9/1985 Denton ..... 114/39
4,563,969 A 1/1986 LeBail ..... 114/102
4,610,212 A 9/1986 Petrovich ..... 114/39
4,624,203 A 11/1986 Ferguson ..... 114/39
4,635,577 A 1/1987 Palmquist ..... 114/39
4,649,848 A 3/1987 Belvedere ..... 114/103
4,682,557 A 7/1987 Magruder et al. ..... 114/39
4,685,410 A 8/1987 Fuller ..... 114/102
4,686,921 A 8/1987 Magnan ..... 114/102
4,706,593 A 11/1987 Vail, Jr. ..... 114/211
4,708,079 A 11/1987 Magnan ..... 114/103
4,733,624 A 3/1988 Belvedere ..... 114/103
4,742,977 A 5/1988 Crowell ..... 244/123
4,756,555 A 7/1988 Bachmann ..... 280/810
4,788,924 A 12/1988 Hamel ..... 114/39.1
4,799,443 A 1/1989 Vogel ..... 114/39.1
4,809,629 A 3/1989 Martinmaas ..... 114/39.1
4,815,681 A 3/1989 Crowell ..... 244/153 R
4,852,507 A 8/1989 Ryon et al. ..... 114/39.1
4,856,447 A 8/1989 Magnan ..... 114/103
4,864,954 A 9/1989 Farrar ..... 114/103
4,890,861 A 1/1990 Bachmann ..... 280/810
4,892,272 A 1/1990 Hadzicki ..... 244/153 R
4,895,091 A 1/1990 Elmali et al. ..... 114/103
4,927,100 A 5/1990 Provenzo, Jr. et al. .. 244/153 R
4,936,236 A 6/1990 Sinden ..... 114/39.1
4,936,242 A 6/1990 Stelniceanu ..... 114/352
4,936,802 A 6/1990 Ueno ..... 440/13
4,970,979 A 11/1990 Bielefeldt ..... 114/39.1
4,982,917 A 1/1991 Graske ..... 244/145
4,998,494 A 3/1991 Deutsch ..... 114/39.2
5,011,099 A 4/1991 Harburg ..... 244/153 R
5,022,337 A 6/1991 Caldwell ..... 114/39.2
5,054,411 A 10/1991 Nelson ..... 114/61
5,058,521 A 10/1991 Payne, III ..... 114/339
5,063,869 A 11/1991 Bielefeldt ..... 114/61
5,064,149 A 11/1991 Prouty ..... 244/155 A
5,076,186 A 12/1991 Girard ..... 114/102
5,120,006 A 6/1992 Hadzicki ..... 244/153 R
5,136,961 A 8/1992 Follett ..... 114/274
5,246,393 A 9/1993 von der Stein ..... 440/67
5,288,038 A 2/1994 Duong ..... 244/153 R
5,355,817 A 10/1994 Schrems ..... 114/39
5,370,561 A 12/1994 Jakobsen ..... 440/14
5,474,257 A 12/1995 Fisher et al. ..... 244/49
5,492,289 A 2/1996 Nosenchuck et al. ..... 244/204
5,517,940 A 5/1996 Beyer ..... 114/354
5,638,763 A 6/1997 Kelsey ..... 114/105

SAILING CRAFT

The present invention relates generally to sailing craft.

Conventional sailing boats use movable mass or buoyancy to balance the capsizing moment caused by the sail force. This mass may be part of the keel, the actual crew on the windward side of the boat, water pumped between tanks, or many other methods which move the centre of mass to the windward side of the boat. Buoyancy moves as the craft tilts and more water is displaced on the leeward side of the hull, or the leeward hull in the case of a multi-hulled craft. Under steady state conditions the three moments must be balanced.

Absolute stability may only be achieved by positioning the sailing craft centre of mass below its centre of buoyancy. This carries a huge weight and wetted area penalty, which makes such craft slow. High speed sailing craft must rely on wide or multi-hull designs and/or movable ballast, usually crew, to achieve stability.

Hydrofoil craft use underwater foils to balance the capsizing moment without moving masses but they do produce the same moment, putting similar stresses on the structure. The total foil force must always be greater than the total craft weight, inducing more parasitic drag in the foils than if the foils were supporting the craft weight alone.

Sailing craft are known which have tilted sail-sails, with the intention of reducing water drag by supporting at least part of the craft on air. The main problem encountered by the most successful of such craft has been instability due to rapid changes in the moments at play. This is also a significant problem with most conventional high speed sailing craft.

All prior art sailing craft achieve equilibrium by balancing large and often rapidly changing moments. High speed sailing craft, as discussed above, cannot be inherently stable and so must sail at the limit of their ability to balance these moments. The fastest boat in a race is therefore usually the one closest to capsizing.

It is an object of the present invention to provide an improved sailing craft which alleviates one or more of the aforementioned problems.

According to the present invention there is provided a sailing craft including a hull assembly, a keel operatively connected to said hull assembly, a turret assembly operatively connected to said hull assembly for at least partial rotation relative thereto about a rotation axis, the turret assembly when in use being adapted to carry the craft's crew, a mast operatively connected to and projecting from the turret assembly, a sail assembly operatively connected to the mast in spaced relation from the turret assembly, said sail assembly including a sail member which is movable relative to the mast and which is adapted to catch the wind so as to provide a force for propelling the craft, the sail assembly further including wind responsive means such as for example a vane operable to position the sail member with respect to the wind direction.

Preferably, the arrangement is such that when the craft is in a normal sailing mode the major forces acting on the craft are substantially directed through the region of a single point. Preferably, the sail assembly, mast, turret and crew have a centre of mass which is at or in the vicinity of that region of the single point. The position of the crew on the turret assembly can be changed so that the position of the centre of mass can be changed.

In one preferred embodiment, the hull assembly has a horizontal plane which is generally parallel to the water upon which it floats when in the normal sailing mode, the rotation axis of the turret assembly being generally vertical to the horizontal plane. Preferably, the centre of mass is in the region of the rotation axis of the turret assembly. Preferably, the hull assembly has a centre of buoyancy and the keel is operatively connected to the hull assembly in the region of the centre of buoyancy.

Preferably, the mast has a longitudinal axis which is from 15° to 75° from the horizontal plane of the hull assembly. Preferably, when in the normal sailing mode the longitudinal axis of the mast passes through the region of the centre of mass.

Preferably, the sail member is operatively connected to the mast for movement relative thereto about 3 axes rotation. Preferably, the sail member is adapted to pitch, roll and yaw with respect to the mast. The sailing craft may further include a rudder for steering the craft.

Preferably, the sail member includes a generally aerofoil shaped body. In one preferred form, the sail includes a frame member with the aerofoil shaped body attached thereto and the wind responsive means being operatively connected thereto. Preferably, the sail includes regulating means such as an elevator which is adapted to change the angle of attack of the aerofoil shaped body.

In one preferred embodiment, the turret assembly includes a main body having opposed end portions, the axis of rotation being disposed between the end portions, the mast being operatively connected at one end portion and the crew support section being disposed towards the other end portion with the axis of rotation being between the mast and the crew support section. The turret assembly may be temporarily prevented from rotation if desired so that the craft is substantially steered by the wind.

According to a preferred form the sailing craft alleviates high speed control problems by directing substantially all major forces acting on the craft through one point or region when in the normal sailing mode. This effectively eliminates the moments which change too rapidly for the helmsman to control when the wind shifts in speed and direction. Wind speed changes on the sailing craft produce only acceleration or deceleration in the intended direction of travel, with no significant tendency to capsize, change course or pitch forward.

A primary benefit of the sailing craft of the invention in its preferred form is that water drag may be reduced by supporting some of the craft weight in a controllable way. The propulsive force available is limited only by sail force and the mass of the boat. At that limit the craft is completely or substantially clear of the water except for the keel and, optionally, the rudder. The resultant low drag allows very high speed.

The fastest way of sailing the sailing craft is to have only its keel in the water. Excessive sail member force will not tend to capsize the craft, but will lift it until the wetted keel area is insufficient to generate enough lift to balance the sail member force. If this happens gradually, the keel efficiency will drop, the boat will lose speed, possibly slip sideways in the downwind direction, and drop lower in the water due to lower apparent wind speed and a consequent reduction of the sail force; that is, it recovers from crew error without a significant penalty like a capsize. If the sail member force rises rapidly the craft becomes completely airborne, it will accelerate sideways (downwind) without the side force of the keel to balance the sail member force side component, lose airspeed as it gets carried with the wind, the severity of the landing depends on the height of the jump, but the skill of the crew, and the design of the craft would make such a manoeuvre possible without damage.

Two automatic operation modes are possible—steering or sail setting. Firstly, with a conventional rudder turning the hull assembly to the desired course and allowing the sail member to automatically drive the turret assembly to the optimum angle. Secondly, as the turret assembly maintains an almost constant angle to the wind when the sail member is loaded, and resists rotation from its optimum position, the hull assembly may be turned with respect to the turret assembly without using a rudder. The turret assembly pivot may also be temporarily locked to make the craft automatically keep a substantially constant bearing with respect to the apparent wind direction. As the craft changes speed however, it will change bearing with respect to the true wind direction.

The mast of a conventional craft is subject to high and variable loads. The mast and associated structure of the proposed craft is subject to a bending moment due to the weight of the sail member at rest, but this moment remains substantially constant under all sailing conditions provided the mast is substantially in line with the sail member force. The sail member force imposes only a relatively small and substantially tensile stress to the mast. The structure may therefore be made lighter and more flexible than in prior art craft.

Preferred embodiments of the invention will be hereinbefore described with reference to the accompanying drawings, and in those drawings.

Figure 4:
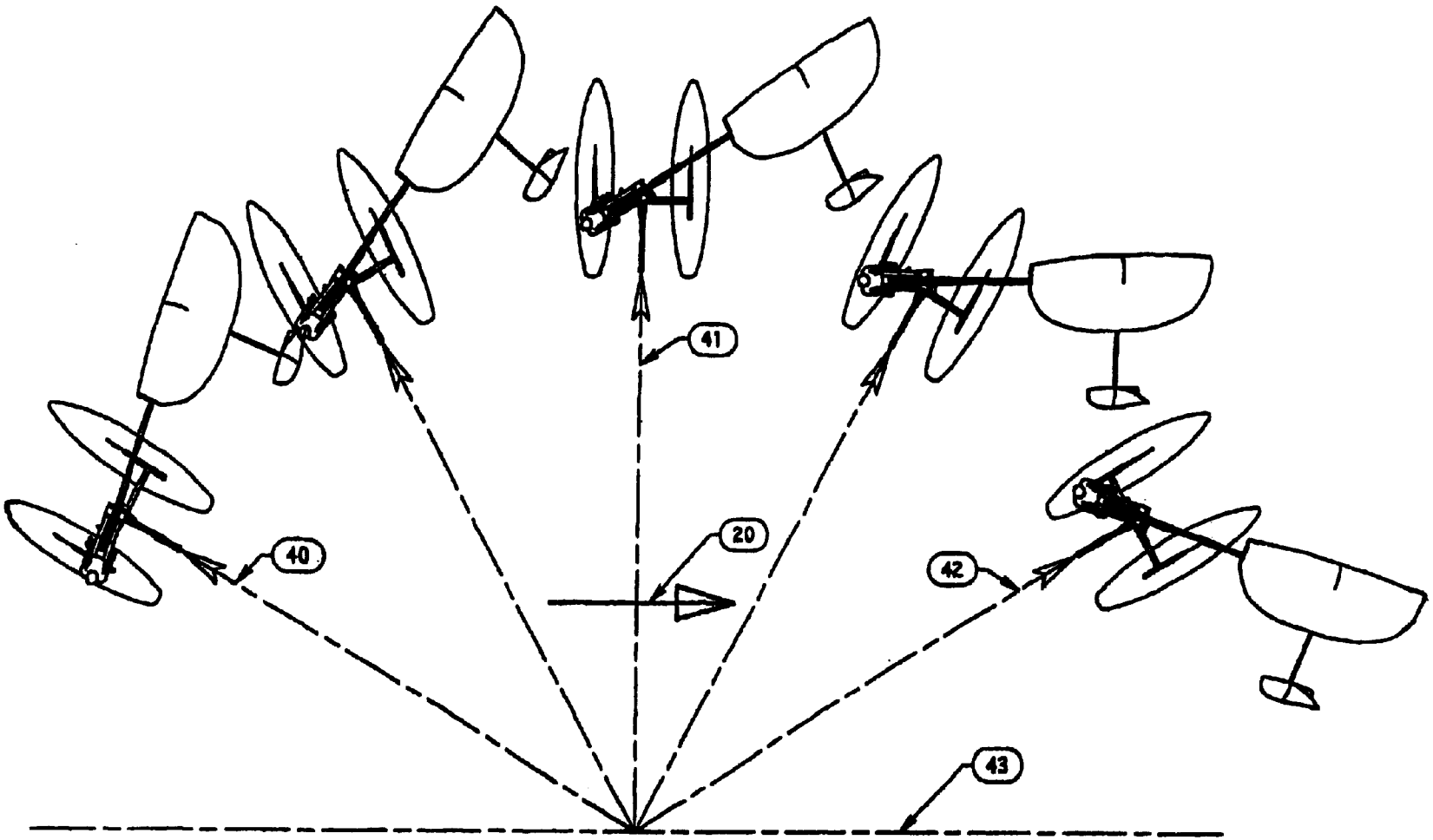
Figure 5:
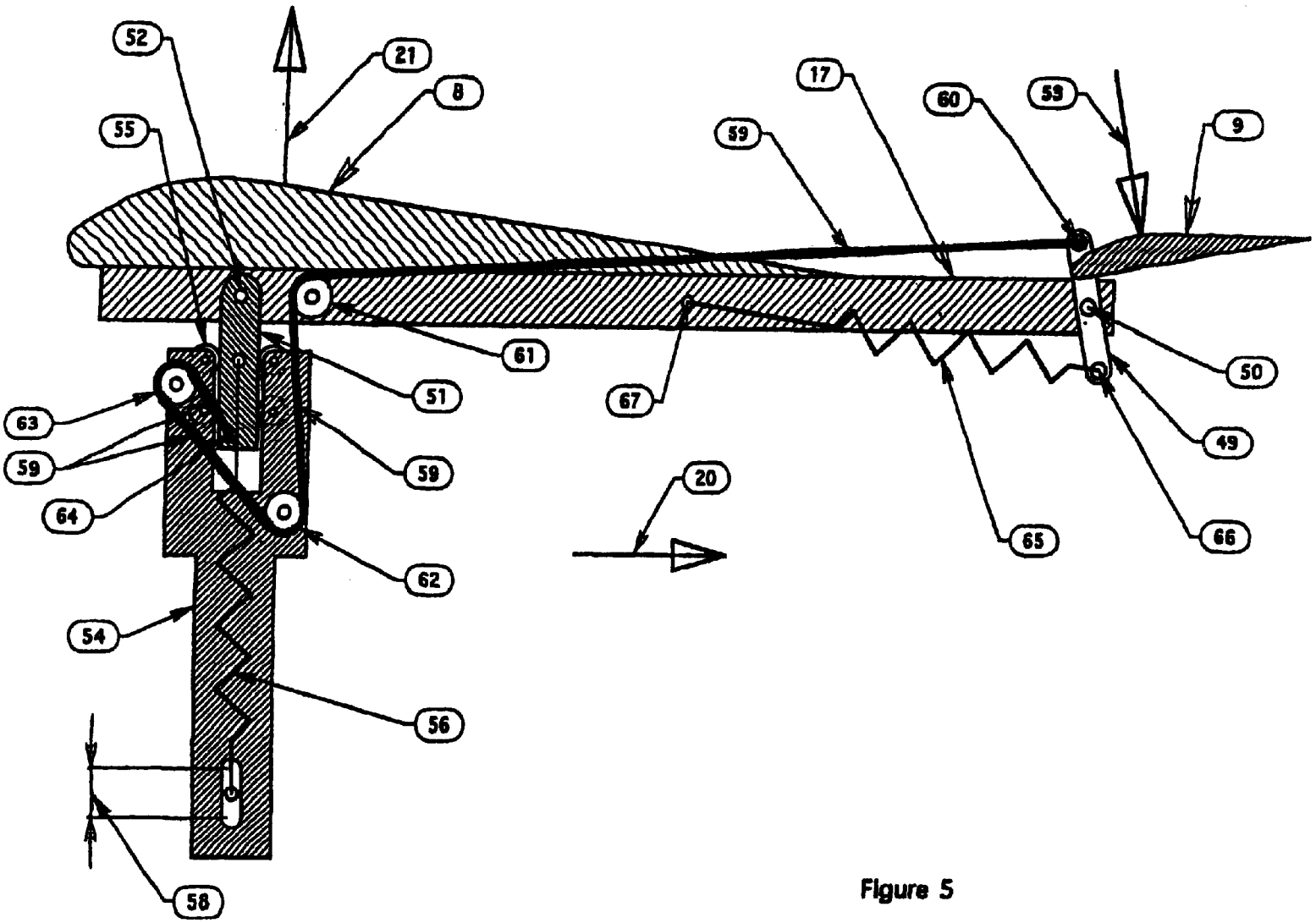
Figure 6:
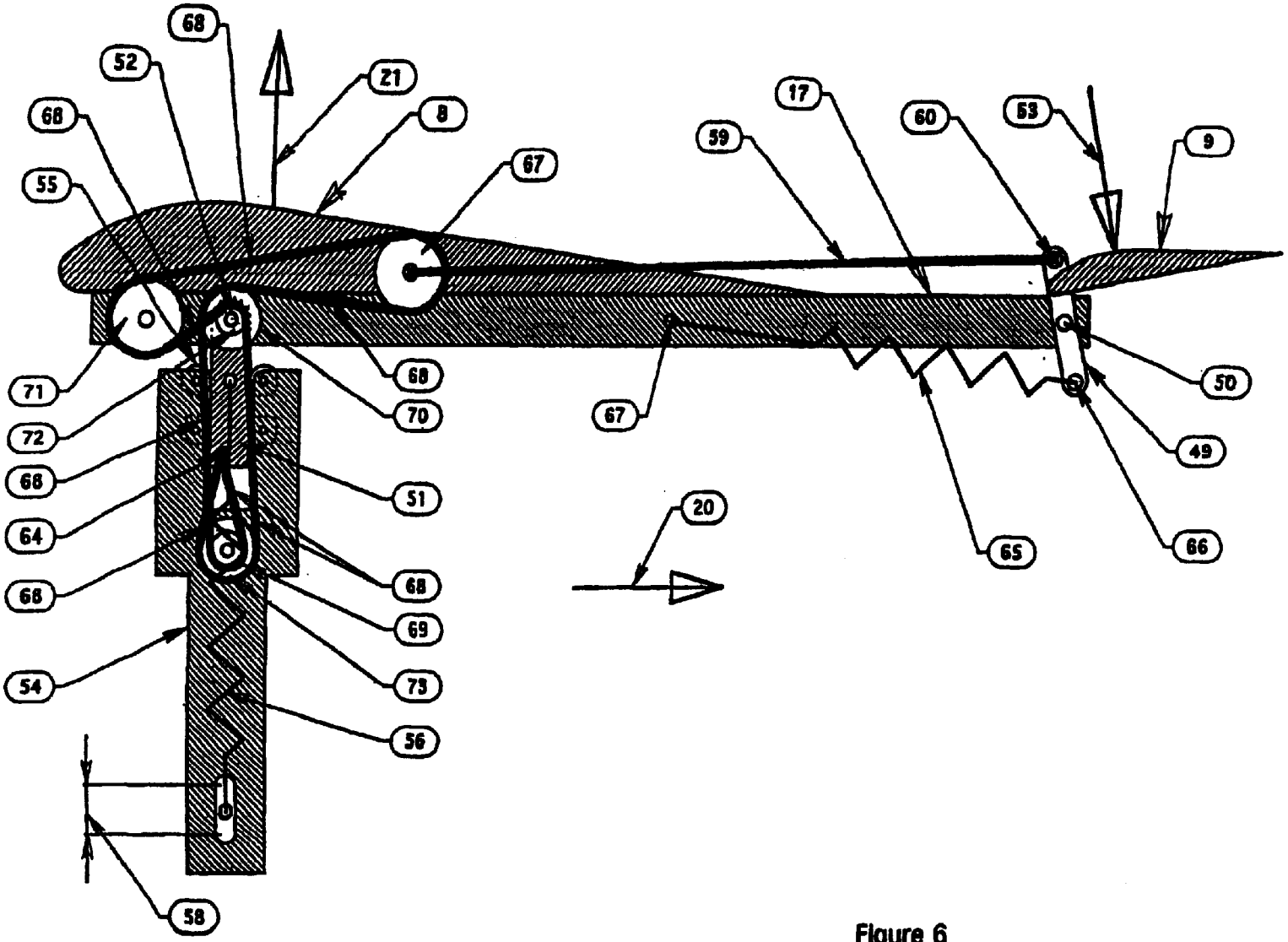
Figure 7:
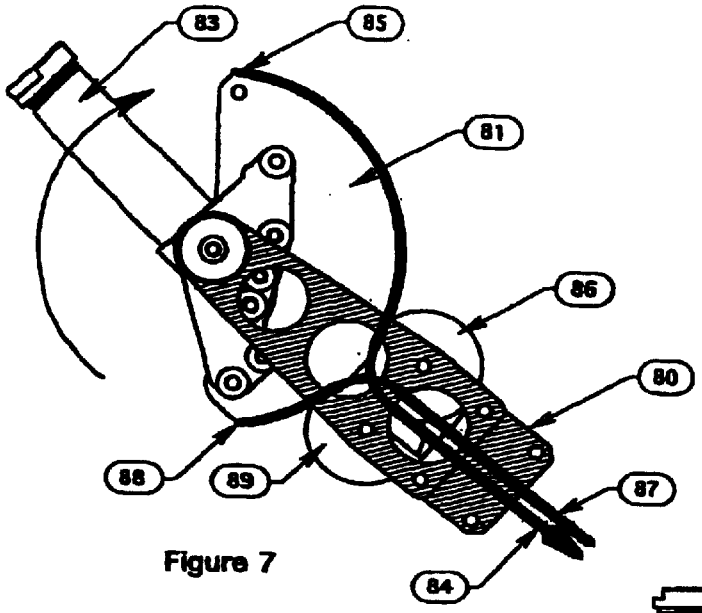
Figure 8:
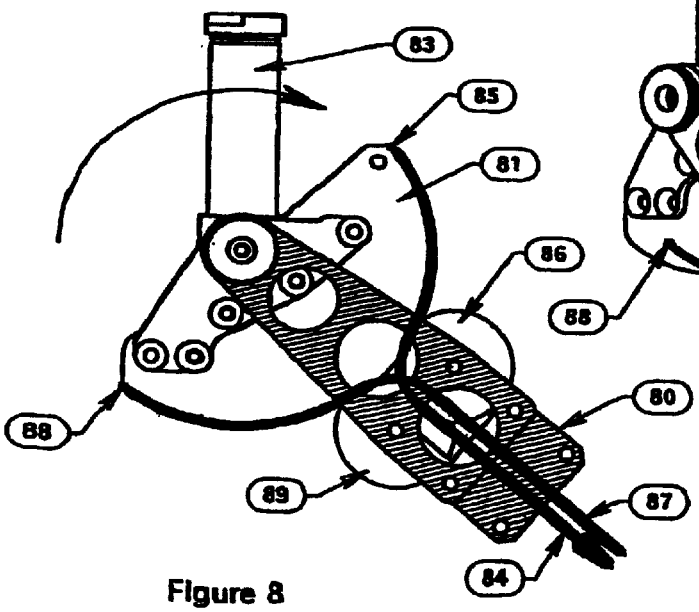
Figure 9:
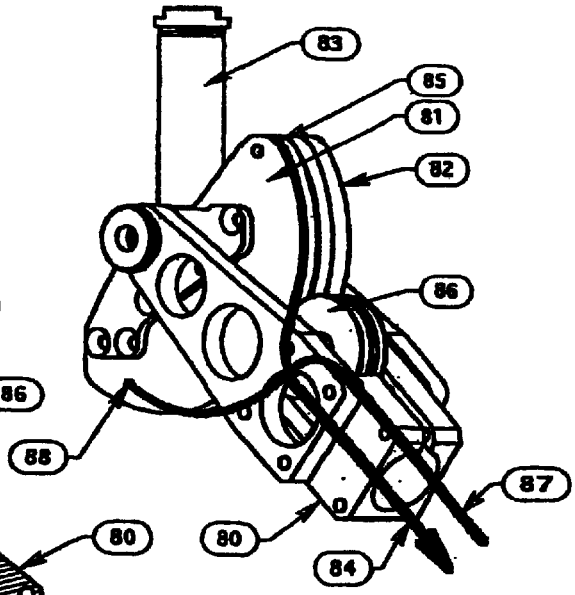
Figure 10:
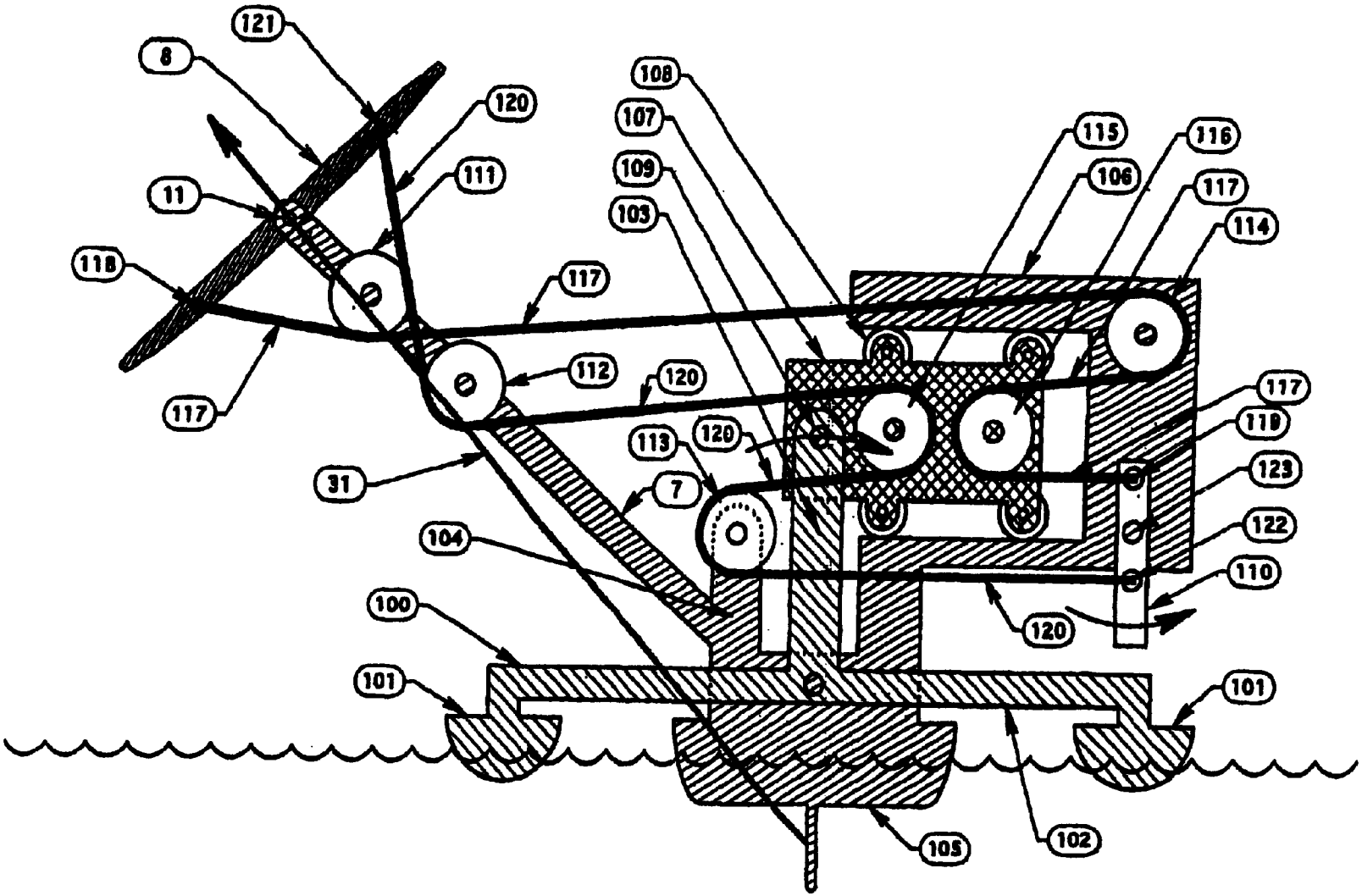
Figure 11:
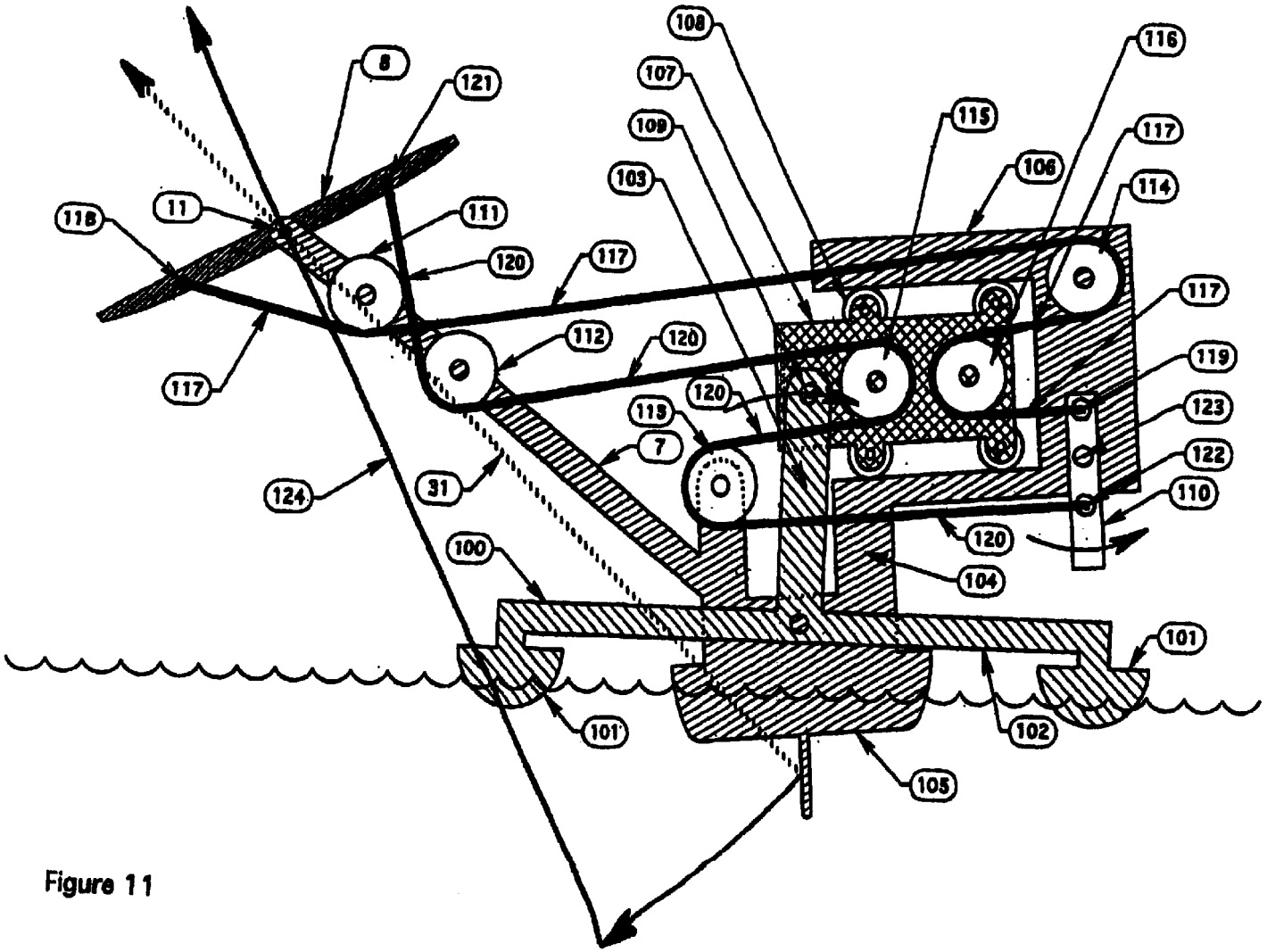

FIG. 4 a schematic illustration of the turret for a range of port tacks;

FIG. 5 is a schematic illustration of one form of a sail force control mechanism;

FIG. 6 is a schematic illustration of another form of a sail force control mechanism;

FIGS. 7 to 9 illustrate a form of roll mechanism;

FIGS. 10 and 11 illustrate a form of anticapsizing mechanism.

Figure 1:
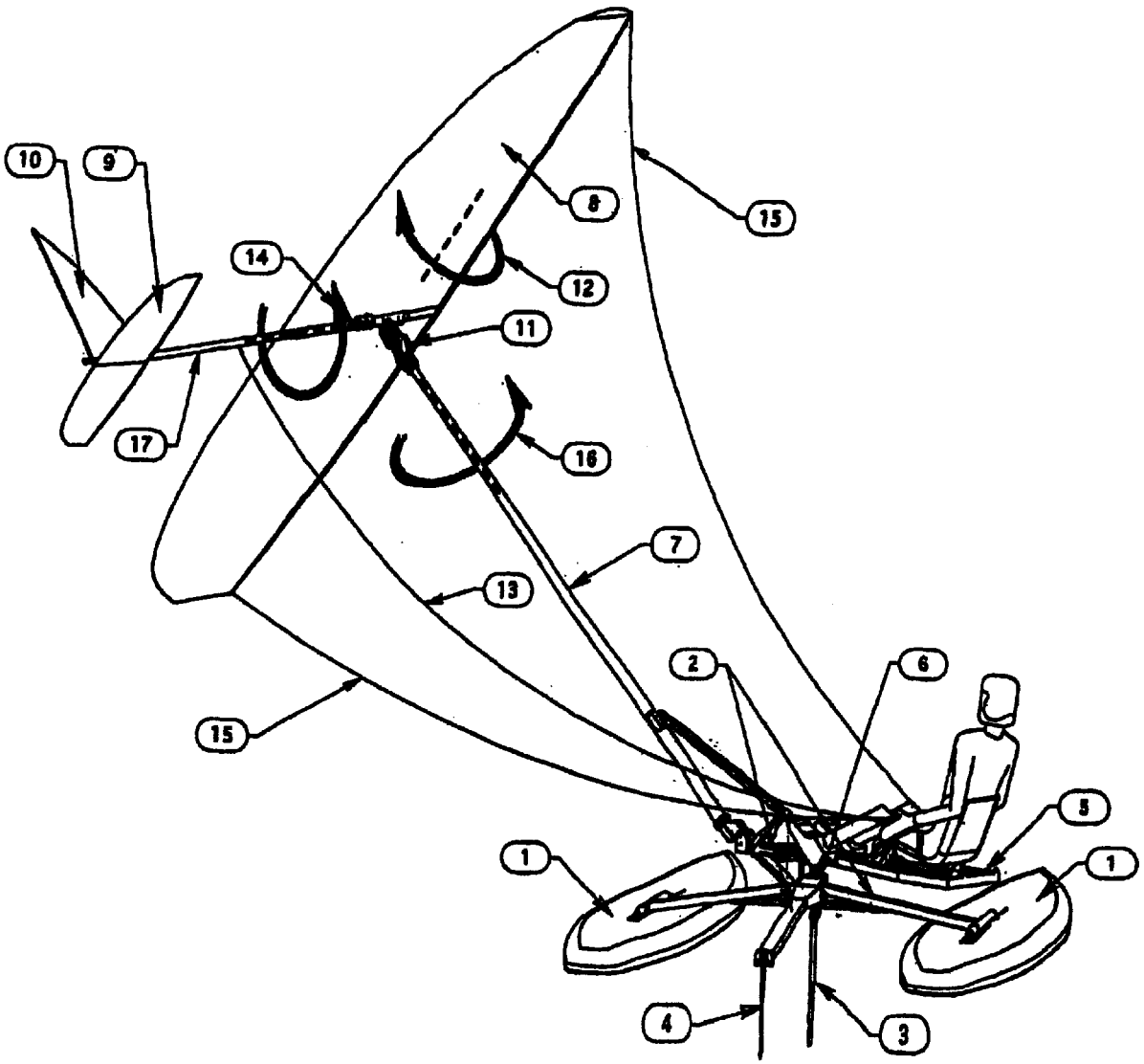
FIG. 1 is a schematic view of a sailing craft according to the present invention.
Figure 2:
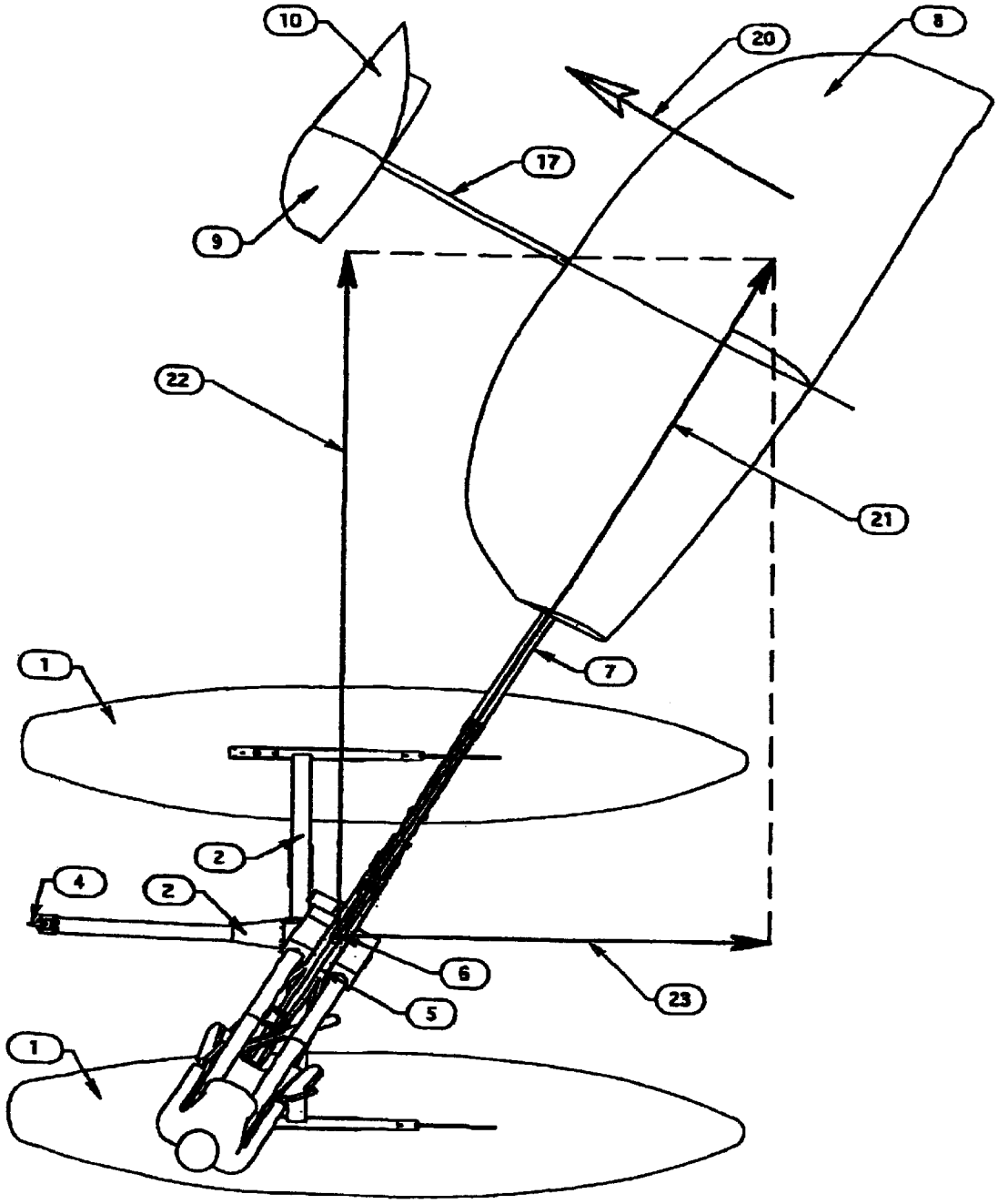
FIG. 2 is a plan view of the craft shown in FIG. 1.
Figure 3:
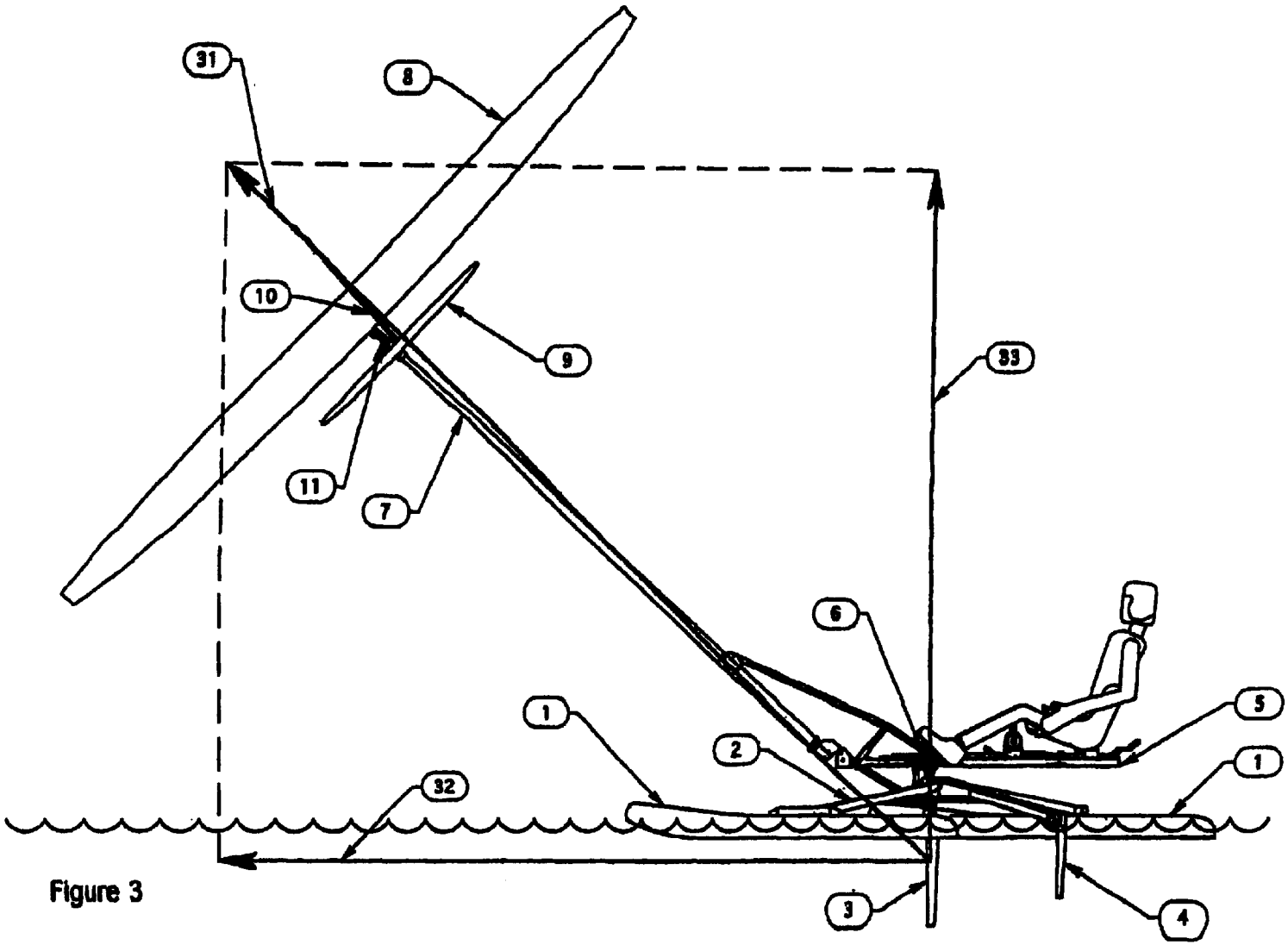
FIG. 3 is a side elevation of the craft shown in FIGS. 1 and 2.

Referring in particular to FIGS. 1 to 3 there is shown a sailing craft which includes a hull assembly comprising one or more hulls 1 connected rigidly or flexibly to each other by a frame 2, a keel or centreboard 3 is attached to the hull assembly near the centre of buoyancy of the hull assembly. A rudder 4 may be attached aft of the keel but is not necessary. The craft further includes a turret assembly 5 is attached to the hull assembly by a bearing 6 with a vertical axis which passes close to the centre of lift of the keel. A mast 7 is operatively connected to the turret assembly and is attached at an angle of 45°±30° from the horizontal when sailing. The mast angle may be fixed or variable to assist in rigging and allowing the sail member to be raised for increased clearance from the water in choppy conditions. The craft further includes a sailing member 8 or sail assembly 8, 9, 10, pivotally attached near its centre of lift to the free end of the mast by control joint 11. The sail assembly may have a tailplane comprising an elevator 9 and a fin 10.

The hull assembly 1–4 provides, as with any conventional sailing craft: buoyancy to support the weight of the craft, and a keel force perpendicular to the direction of travel as a reaction to that component of the sail force. It may also provide stability against pitch or roll.

The turret assembly 5–7 provides accommodation for the crew and transmits the sail member force, through the mast 7, to the centre of the craft. It is able to slew, like the turret on a military tank, about the vertical axis with respect to the hull assembly, to allow travel through the water in any direction normally possible in a conventional sailing craft. FIG. 4 illustrates that for all points of sailing, the sail is forward of the turret bearing axis so that the turret needs only to travel through an angle of approximately 180°, unless the craft needs to be sailed backwards.

The turret assembly may be linked to the keel such that its only rotational degree of freedom is about its vertical axis. However flexibility about horizontal axes may be used to allow the turret assembly to remain steady while the hull assembly tilts in response to waves. In this case, if the turret assembly tilts about any horizontal axis, the keel tilts with it by the same angle. This is particularly important regarding tilt about the transverse axis (horizontal and normal to the direction of travel). Referring to FIG. 3: this means that if the turret assembly 5 with all attachments including the mast 7 and sail 8, rotates clockwise in the plane of the page, the keel 3 will rotate by substantially the same angle in the same direction. For small angles, this minimises changes in the vertical force component 33 as the craft rolls in a swell, thereby reducing any tendency for the craft to rise and fall under such conditions. For example, a 10° clockwise roll angle will increase the vertical lift component 33 by less than 2% for constant sail force 31 with the described mechanism; whereas with a fixed vertical keel 3 under the same conditions, the rise in sail force vertical component 33 would be almost 18%. If the craft is sailing near the point of becoming airborne, such a feature is important for stability.

The sail assembly 8–10 is operatively connected to the end of the mast 7 and has three axes of rotation allowed by the control joint 11 described here in conventional aircraft nomenclature: Pitch 12, or angle of attack, is controlled by the crew and determines the force generated by the sail member in response to the air velocity incident on it. In the embodiment shown in FIGS. 1, 2 and 3 this is done indirectly by changing the angle of attack of the elevator 9 or directly by pulling the control line 13. The pitch is increased to produce a higher sail member force and drive the craft faster. Roll 14 is controlled by the crew, and determines the capsizing moment generated by the sail member. In the embodiment shown in FIGS. 1, 2 and 3 this is done by bridle lines 15 attached to the or the sail member. The same effect may be achieved by warping the tips through a lever system within the skin of the sail member (not shown), or through the use of ailerons (not shown). Roll is controlled to keep the craft from capsizing: rolling the sail member in the direction of the arrow 14 tends to capsize the boat downwind; rolling in the opposite direction has the opposite effect. It is possible to capsize the craft upwind as well as in the conventional downwind direction, but the roll is generally used to keep the craft as level as possible without needing to use conventional weight shift. Unlike a conventional craft, if the sail member roll is trimmed correctly there is no capsizing moment.

Yaw 16 is controlled by the wind, as with a weather vane, and allows the sail assembly 8–10 to pivot freely about the axis perpendicular to its main lifting surface so that it always faces into the wind. In the embodiment shown in FIG. 1 this is done by the fin 10, but may be achieved by using a swept sail member and/or fins.

The sail assembly behaves much like a kite on a string, adjusting automatically to wind direction and always directing its force away from the centre of the craft. During wind direction shifts the force will move away from this position, causing the turret to swing until it regains equilibrium, much as a kite does.

As discussed the craft exhibits zero moment due to centre of mass position. The combined centre of mass of the turret assembly, sail assembly and crew is designed to lie close to the rotational axis of turret bearing 6 while sailing. During assembly the mast may be lowered to facilitate said assembly attachment: this may move the centre of mass temporarily. The result is that no substantial moment about the rotational axis of the turret bearing is produced by the action of acceleration in any direction. For example, sudden deceleration caused by hitting a wave will not cause the turret to swing significantly away from its existing angle. Moments about the horizontal axes are also substantially immune to vertical accelerations, including gravity. Moments about the horizontal axes are not balanced under the action of horizontal accelerations, however. The vertical position of the centre of mass is almost inevitably above the waterline, but well below the sail member. As the largest horizontal accelerations are produced by forces originating from the sail member or components in the water, there will be unbalanced pitching and rolling moments produced by forward and sideways accelerations respectively. Hitting a wave, for example, will produce a pitching, bow down, moment. However, the moment of inertia of the turret and sail assembly will help resist pitching. Also, the forward swing of the sail member will move its line of action in front of the combined centre of mass of the turret and sail assemblies, generating a restoring moment to pitch the bow up again. This is because the sail force direction is substantially constant with respect to the apparent wind direction. In other words, the sail member behaves like a vertical force lifting and object on a string: the object naturally tends towards a position directly under the force, even if it starts to one side.

Because of the arrangement of the various components of the craft it exhibits zero moment due to wind force. Insofar as horizontal force components are concerned and referring to the plan force diagram in FIG. 2 in which the apparent wind direction is indicated by arrow 20. When sailing under steady state conditions, the line of action of the sail member force 21 passes through the keel substantially at its hydrodynamic centre of force, the sail force side component 22 is substantially balanced by the keel horizontal force (not shown), and the thrust component of the sail force 23 is available to overcome drag from the keel, rudder and hulls. As there is no significant capsizing moment as shown above, and the centre of mass of the craft is on the fore-aft centreline of the keel as shown above, the centre of drag of all the wetted parts will be effectively on the line of the thrust component 23. The result is that changes in sail force have no significant tendency to turn the craft.

Insofar as vertical force components are concerned and referring to the mast elevation plane force diagram in FIG. 3 in which the apparent wind direction is out of the page towards the reader, when sailing under steady state conditions, the line of action of the sail force 31 passes substantially through the keel at its centre of force, the wind force side component 32 is substantially balanced by the keel horizontal force and overall drag force explained above. The sail force vertical component 33 acts effectively through the centre of mass of the entire craft, including crew, tending to lift it evenly out of the water.

FIG. 4 shows turret positions for a range of port tacks. The wind direction 20 applies to all directions shown:

Direction 40 is a close reach.

Direction 41 is a beam reach.

Direction 42 is a broad reach. As with conventional high speed sailing craft, sailing directly downwind will usually be slower between marks than taking course 42 and jibing to the opposite course.

Starboard tacks are identical to FIG. 4 but mirrored about axis 43 so that the sail is over the port side of the craft.

Note that the sail angle of attack is similar to that of a conventional sailing craft, being close to parallel to the direction of travel in the close reach, and progressively further away from parallel as the course swing to broad reach.

The craft must operate most of the time with at least some of the keel in contact with the water, as the keel force prevents the craft side slipping with the wind. The highest efficiency is achieved with all but the keel out of the water, so it is important to control the height of lift accurately. This can be done by controlling the sail force or the keel force direction either manually or automatically. The sail force is the obvious first choice as it must be controllable to prevent damage in high winds. Sail force may be controlled by allowing the joint 11 in FIG. 1 to be extendible and spring loaded against the sail force.

A preferred embodiment of the sail force control mechanism is shown diagrammatically in FIG. 5, in which the air flow direction is shown by the arrow 2. The mechanism comprises a sail keel tube 17 on which the sail 8 is substantially rigidly mounted, and the elevator lever 49 is attached at the pivot 50. The elevator 9 is rigidly attached to the elevator lever and driven by it.

The sail keel tube 17 is attached to the sail slide 51 at pivot 52 which allows the sail to change angle of attack and therefore its lift force, under the action of the elevator 9 down force 53. The sail slide 51 is free to slide over a limited stroke in the fork 54 which is connected via the remainder of the sail control joint 11 shown in FIG. 1 to the top end of the mast 7 also shown in FIG. 1. The slide may be supported by rollers 55 or other friction-reducing means. The slide 51 is pulled down by the sail load tension spring 56. The spring may be a conventional spring or a long length of rope or cable of known elasticity. The elevator control cable 59 is attached to the elevator lever 49 at the pivot 60, then runs around the pulley 61 attached to the sail keel tube 17, then around the pulleys 62 and 63 which are attached to the fork 54, then to the sail slide 51 at attachment point 64. The cable tension is opposed by the elevator return spring 65 which is pivotally mounted between the elevator lever 49 at 66 and the sail keel tube 17 at 67.

The helmsman is able to select any desired sail load which will remain substantially constant, independent of wind or boat speed. The sail force control mechanism functions as follows:

If FIG. 5 shows the mechanism at equilibrium, then an increase in sail force 21 due to a wind gust will extend the sail load spring 56,; raising the sail slide 51. Cable 59 is consequently slackened, allowing the elevator 9 to be pulled down by the elevator return spring 65, reducing the elevator force 53 due to the lower angle of attack. The reduced elevator down force allows the tail to rise, reducing the sail angle of attack and therefore the sail force 21.

Depending on damping, the mechanism may oscillate slightly before settling to a sail force slightly higher than the original set point.

The basic sail control mechanism is shown diagrammatically in FIG. 5 is sensitive to changes in angle of attack such that as the sail rotates clockwise, the cable length shortens between pulleys 61 and 62. This will cause the elevator position to change independently of movement of the sail slide 51 with respect to the fork 54. Depending on the actual dimensions of the mechanism, this could cause undesirable effects.

A further preferred embodiment of the sail force control mechanism is shown diagrammatically in FIG. 6, in which the air flow direction is shown by the arrow 20, operates independently of the sail angle of attack. The mechanism comprises a sail keel. tube 17 on which the sail 8 is substantially rigidly mounted, and the elevator lever 49 is attached at the pivot 50. The elevator 9 is rigidly attached to the elevator lever and driven by it. The sail keel tube 17 is attached to the sail slide 51 at pivot 52 which allows the sail to change angle of attack and therefore its lift force, under the action of the elevator 9 down force 53. The sail slide 51 is free to slide over a limited stroke in the fork 54 which is connected via the remainder of the sail control joint 11 shown in this FIG. 1 to the top end of the mast 7 shown in this FIG. 1. The slide may be supported by rollers 55 or other friction reducing means. The slide 51 is pulled down by the sail load spring 56 force 57. The elevator control cable 59 is attached to the elevator lever 49 at the pivot 60 at one end, and the housing of a free pulley 67 at the other. A second cable 68 is attached to the sail slide 51 at 64, then wraps around the pulleys 69, 70, 67, 71, 72 and 73, then back to the sail slide 51 at attachment point 64. Pulley 67 is constrained only by the cables 59 and 68 attached to it. Pulleys 70 and 72 are substantially the same diameter, although shown different diameters for clarity, and have their pivots substantially coincident with the sail slide pivot 52. Pulley 71 has its pivot on the sail keel 17 or any part mounted substantially rigidly to it. Pulleys 69 and 73 have their pivots on the fork 54. The cable tension is opposed by the elevator return spring 65 which is pivotally mounted between the elevator lever 49 at 66 and the sail keel tube 17 at 67.

Operation is substantially the same as for the basic power control mechanism in that movement of the sail slide 51 down into the fork 54 pays out cable 68 causing pulley 67 to move to the right, reducing the elevator angle. The improvement lies. in the fact that as the angle of attack changes, pulleys 70 and 72 respectively unroll and roll up substantially the same length of cable. The pulley 67 therefore rotates as the angle of attack changes, but its centre does not move, so that the elevator angle does not change. This allows the sail to keep a substantially constant force while the mast swings with respect to it, reducing instability of the control system due to inputs from unwanted sources.

The craft has no inherent stability against capsizing once its hulls have lifted from the water. A preferred configuration is a trimaran with small outriggers which remain in contact with the water after the main hull is airborne to give some capsize stability with minimum drag. During high speed runs, the crew could raise the outriggers from the water and control the sail roll manually. During long runs the outriggers provide a direct anti-capsize moment through buoyancy or planing, or pivot upwards to drive an automatic mechanism on the sail. For example, ropes joining each outrigger to each side of the sail in such a way that a capsizing tilt would make the sail more horizontal would prevent capsize if the sail roll produced was significantly greater than the capsizing angle, relative to the boat.

A preferred embodiment of the sail roll mechanism, which is part of the sail control joint 11, is shown in FIG. 7 in the normal running position, and in FIGS. 8 and 9 in die sail horizontal position. The mechanism comprises the following major assemblies. Firstly the main cradle assembly 80, shown crosshatched in FIGS. 7 and 8, which is substantially rigidly attached to the top end of the mast 7 shown in FIGS. 1, 2 and 3. Secondly the pulley segments 81 and 82 which are substantially rigidly attached to the sail yaw journal 83. The latter forms the inner part of the sail yaw bearing which also forms part of the sail control joint 11 and allows the sail to yaw so that it always faces the apparent wind like a weather vane. The control cable 84 has its end fixed to the pulley segment 81 at 85, it wraps around the pulley segment 81, before passing over pulley 86, then down the mast (not shown). The control cable 87 has its end fixed to the pulley segment 89 at 88, and wraps around the pulley segment 82, before passing over pulley 89, then down the mast (not shown).

The purpose of the mechanism is to remotely roll the sail clockwise or anti-clockwise by pulling the two cables 84 and 87 respectively. This may be done by driving the sail structure directly, functionally identical to cables 15 in FIG. 1, or by driving ailerons or some equivalent prior art aeronautical device which uses air flow to cause the sail to roll. The mechanism is shown in FIG. 7 in the normal running position as in FIGS. 1 to 4, and in FIGS. 8 and 9 in a position which would make the sail substantially horizontal.

A preferred embodiment of the automatic anti-capsizing mechanism is shown in schematic diagrams in FIGS. 10 and 11. The mechanism comprises the following major parts and assemblies. The outrigger assembly 100, comprising floats 101 cross beam 102 and control lever 103. The main hull and mast assembly 104 which behaves as a substantially rigid body and comprises a main hull 105, mast 7, control housing 106, and the sail control joint 11 represented as a simple pivot for the sake of clarity; details are shown in FIGS. 7, 8 and 9; the sail 8 which may be controlled directly or as described above; the roll control slide 107 shown supported by four wheels 108, slidably mounted within the guides of the control housing 106, and driven by pin 109 attached to control lever 103; The rollset-point lever 110, which is pivoted on the main hull and mast assembly 104, at 123; pulleys 111, 112, 113 and 114 each with pivots attached to the main hull assembly 104; pulleys 115 and 116 both with pivots attached to the roll control slide 108; the control cable 117 is attached to the sail 8 at 118, passes around pulleys 111, 114, and 116 then attaches to the roll set-point lever 110 at 119; the control cable 120 is attached to the sail 8 at 121, passes around pulleys 112, 115 and 113 then attaches to the roll set-point lever 110 at 122.

Operation of the automatic anti-capsizing mechanism, with the wind direction being substantially perpendicular to the page, is as follows under steady state conditions as shown in FIG. 10, the sail force passes through the centre of lift of the keel, producing no capsizing moment. The roll set-point lever 110 is locked in the position set by the crew. When a disturbance starts to capsize the craft as shown in FIG. 11, the outrigger assembly 100 stays substantially horizontal so that the attached lever 103 pushes the roll control slide 107 to the right, which slackens cable 120 and tightens cable 117. The sail assembly 8 is therefore driven clockwise, rotating the line of action of its lift force to the left of the keel. This produces a clockwise moment which tends to bring the craft back to the horizontal. If, for any reason the craft tends to list under steady-state conditions, the roll set-point lever 110 may be adjusted by the crew until the craft is horizontal or at another desired angle: the mechanism then works to maintain the new set point. Note that as with all such proportional controls (where the restoring action is proportional to the deviation from the set point), the control will not restore the craft exactly to the set position, but will behave much as a conventional ballasted keel sailing boat and heal, but not capsize.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

The claims defining the invention are as follows:

1. A sailing craft including a hull assembly, a keel operatively connected to said hull assembly, the hull member having a generally horizontal plane which is generally parallel to the water upon which it floats when in a normal sailing mode, a turret assembly operatively connected to said hull assembly for at least partial rotation relative thereto about a rotation axis, the turret assembly when in use being adapted to carry the craft's crew, a mast operatively connected to and projecting from the turret assembly, said mast having a longitudinal axis which is inclined to the horizontal plane of the hull assembly when in the normal sailing mode, a sail assembly operatively connected to the mast in spaced relation from the turret assembly, said sail assembly including a sail member which includes a generally aerofoil shaped body which is pivotally movable relative to the mast and which is adapted to catch the wind so as to provide a force for propelling the craft, the sail assembly further including wind responsive means which is operable to position the sail member with respect to the wind direction.

2. A sailing craft according to claim 1 wherein when the sailing craft is in its normal sailing mode the major forces acting on the craft when it is being sailed are substantially directed through a region of a single point.

3. A sailing craft according to claim 1 wherein the sail assembly, mast, turret and crew have a centre of mass which is at or in the vicinity of said region of the single point.

4. A sailing craft according to claim 1 wherein the rotation axis of the turret assembly is generally vertical to the horizontal plane.

5. A sailing craft according to claim 1 wherein the centre of mass is in the region the rotation axis of the turret assembly.

6. A sailing craft according to claim 1 wherein the hull assembly has a centre of buoyancy and the keel is operatively connected to the hull assembly in the region of the centre of buoyancy.

7. A sailing craft according to claim 1 wherein the longitudinal axis of the mast is inclined from 15° to 75° from the horizontal plane of the hull assembly and when in the normal sailing mode passes through the region of the centre of mass.

8. A sailing craft according to claim 1 wherein the sail member is operatively connected to the mast for movement relative thereto about 3 axes of rotation.

9. A sailing craft according to claim 1 further including a rudder for steering the craft.

10. A sailing craft according to claim 1 wherein the sail member includes a frame member with the aerofoil shaped body attached thereto and the wind responsive means being operatively connected thereto.

11. A sailing craft according to claim 1 wherein the sail member includes regulating means controlled by the crew, which is adapted to change the angle of attack of the aerofoil shaped body.

12. A sailing craft according to claim 1 wherein the turret assembly includes a main body having opposed end portions, the axis of rotation being disposed between the end portions, the mast being operatively connected at one end portion and the crew support section being disposed towards the other end portion with the axis of rotation being between the mast and the crew support section.

13. A sailing craft according to claim 1 further including means for controlling movement of the sail member at the turret assembly.

14. A sailing craft according to claim 1 wherein the turret assembly is temporarily prevented from rotation so that the craft is substantially steered by the wind.

15. A sailing craft according to claim 1 wherein said wind responsive means is a vane.

16. A sailing craft according to claim 11 wherein said regulating means is an elevator.

* * * * *